United States Patent [19]

Blase

[11] 4,102,174

[45] Jul. 25, 1978

[54] MULTI-TRACK MACHINE PRESS

[76] Inventor: Robert Blase, 1009 Round Hill Rd., Fairfied, Conn. 06430

[21] Appl. No.: 703,801

[22] Filed: Jul. 9, 1976

[51] Int. Cl.[2] ..... B21D 43/02

[52] U.S. Cl. ..... 72/421

[58] Field of Search ..... 72/405, 404, 421, 339, 72/462; 113/116 V, 116 Y, 113 R

[56] References Cited

U.S. PATENT DOCUMENTS

| | | | |
|---|---|---|---|
| 1,725,300 | 8/1929 | Pierson | 113/113 R |
| 2,305,064 | 12/1942 | Colwell | 72/336 |
| 3,555,861 | 1/1971 | Staecker | 72/421 |
| 3,862,564 | 1/1975 | Blase | 72/421 |

*Primary Examiner*—C.W. Lanham
*Assistant Examiner*—Gene P. Crosby
*Attorney, Agent, or Firm*—Mattern, Ware, Davis & Stoltz

[57] ABSTRACT

A multi-track machine press is disclosed having a base, a vertically movable ram mounted to the base, and a plurality of horizontally movable slides under the ram. A plurality of master die sets each comprising a plurality of step-height dies arrayed parallel to the motion of the slide have a lower half mounted to the slide and an upper half mounted to the corresponding portion of the ram directly over the particular slide. The slides move horizontally in unison. The upper and lower portion of each master die set come together during a work stroke for a stamping operation when the slides are at a first zero velocity position, and are indexed one die lead for a transfer operation during a deposit stroke when the slides are at a second zero velocity position. The multi-track machine press is thus capable of performing a series of separate die stamping operations while minimizing the amount of scrap from the coil strip stock fed into the press for producing parts.

9 Claims, 11 Drawing Figures

FIG. 1
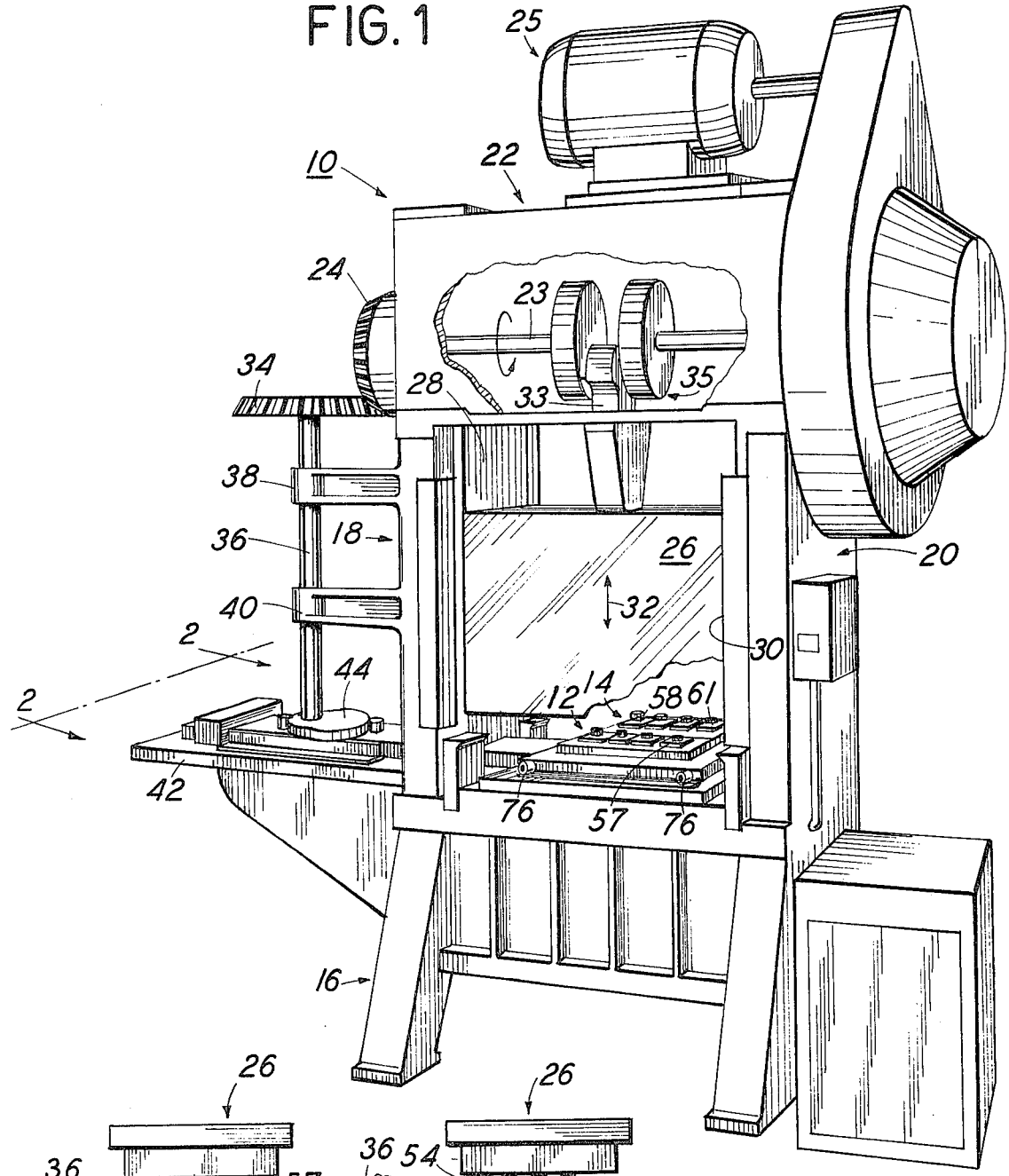
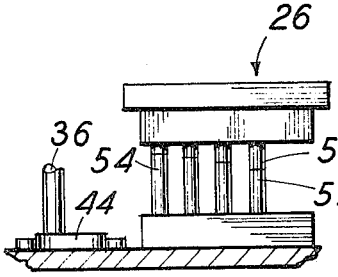
FIG. 1A
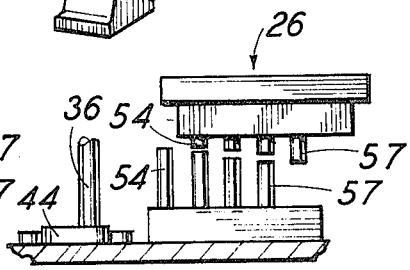
FIG. 1B

MULTI-TRACK MACHINE PRESS

BACKGROUND OF THE INVENTION

1. Field Of The Invention

This invention relates to machine presses, and particularly to machine presses with slides for performing cutting, forming, and transfer operations. The present invention is directed to such machine presses further comprising a plurality of slides for performing simultaneous multiple die stamping operations to several workpiece blanks removed from the same coil strip stock.

2. Prior Art

Although machine presses having a slide under a vertical driven press ram member are well known in the art, such presses have typically utilized only one master die set for generating a desired finished product. One such patent is U.S. Pat. No. 3,862,564, Blase, entitled "Machine Press With Positive Cam Driven Sliding Bed and Cam Activated Auxiliary Systems", which discloses a machine press wherein the vertical ram actuation and slide movement are positively mechanically interrelated to one another so as to perform multiple stamping and transfer operations to a workpiece blank. U.S. Pat. No. 3,862,564 is hereby incorporated by reference in this application.

The present invention expands upon such machine presses having a slide under a vertically driven ram by further providing at least one additional slide operating in conjunction with the first slide so as to allow the use of a plurality of master die sets on one machine press. In this manner, more than one die stamped part from separate workpiece blanks may be formed at the same time on different master die sets. Furthermore, the machine press is not only capable of generating additional finished die stamped items at the same time, but is also able to greatly minimize scrap normally associated with machine presses by proper feeding of the coil strip stock.

SUMMARY OF THE INVENTION

A multi-track machine press according to the present invention comprises a weighted ram carrying the upper portion of two or more master die sets. The ram is mounted for sliding vertical motion, and is driven by an overhead motorized crankshaft. Two or more slides are mounted for simultaneous sliding horizontal motion beneath the ram, and the second, lower portion of each master die set is carried by one of these slides.

The slides are connected to a pair of adjustable cross-members so as to move in unison while being properly spaced from each other. Connected perpendicularly to the cross-members is an elongated drive assembly passed beneath and along the longitudinal sliding length of the slides. This drive assembly incorporates a drive bar that passes through a series of apertured pillow blocks which maintain the desired orientation of the drive bar.

The drive bar is driven by a cam connected to a positive mechanical link comprising a shaft driven by the crankshaft through a 2:1 gearing reduction. The cam contacts a pair of upstanding cam followers on the drive bar.

The shape of the cam provides a modified sinusoidal variation of velocity and acceleration along the longitudinal length of the drive bar which, in turn, is imparted to the slides. The slides are thus caused to be stationary at the time contact between the two die portions of the master die sets occurs during each work stroke and when these die sets are in close aligned proximity for transfer operations during each deposit stroke.

By proper spacing of the slides, concentric blanks may be removed from the coil or material strip stock. Similarly, blanks may be removed from the material strip in any other desired order or configuration in order to minimize scrap.

OBJECTS OF THE INVENTION

It is therefore a principal object of the present invention to provide a multi-track machine press wherein a plurality of slides interact with a vertically moving ram to simultaneously generate a plurality of machine pressed items;

An additional object of the present invention is to provide a multi-track machine press of the above description wherein the lateral displacement of the slides with respect to each other is adjustable and positively maintainable;

A further object of the present invention is to provide a multi-track machine press of the above description wherein successive slides of the press are capable of removing a portion of the coil strip stock surrounding a region previously removed by a master die set on a preceding slide thereby minimizing coil strip scrap;

Another object of the present invention is to provide a multi-track machine press of the above description wherein successive slides of the press are capable of removing a blank from the coil strip stock in any desired orientation so as to minimize coil strip scrap;

Other objects of the present invention will in part be obvious and will in part appear hereinafter.

THE DRAWINGS

For a fuller understanding of the nature and objects of the invention, reference should be had to the following detailed description taken in conjunction with the accompanying drawings, in which:

FIG. 1 is a perspective partially cut-away view of the multi-track machine press according to the present invention, illustrating the master die sets aligned for a cutting and stamping operation during a work stroke;

FIG. 1A is a diagrammatic partially cut-away front view of the multi-track machine press of FIG. 1 with the master die sets aligned for a cutting and stamping operation during a work stroke;

FIG. 1B is a diagrammatic partially cut-away view of the multi-track machine press of FIG. 1 with the master die sets aligned for a transfer operation during a deposit stroke;

FIG. 2A and 2B are put together to form FIG. 2;

Figure 6A:
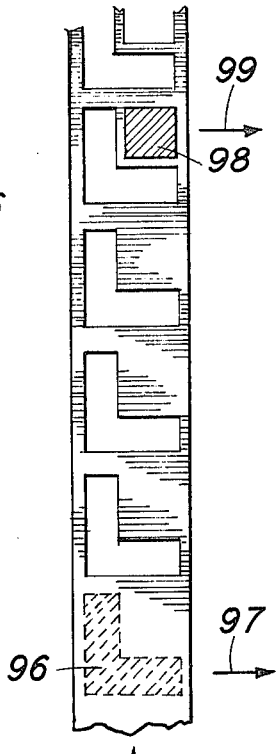
Figure 6B:
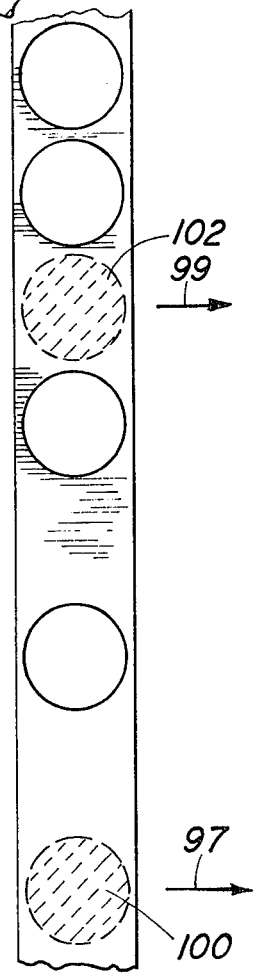

FIG. 6A is a partially cut-away top plan view of a coil strip stock used in conjunction with the present invention illustrating one configuration for the removal of different type blanks from the same coil strip; and FIG. 6B is a top plan view of a coil strip stock similar to that shown in FIG. 6A illustrating a second blanking arrangement for removing blanks in a tandem arrangement from the same coil strip.

DETAILED DESCRIPTION

Figure 3:
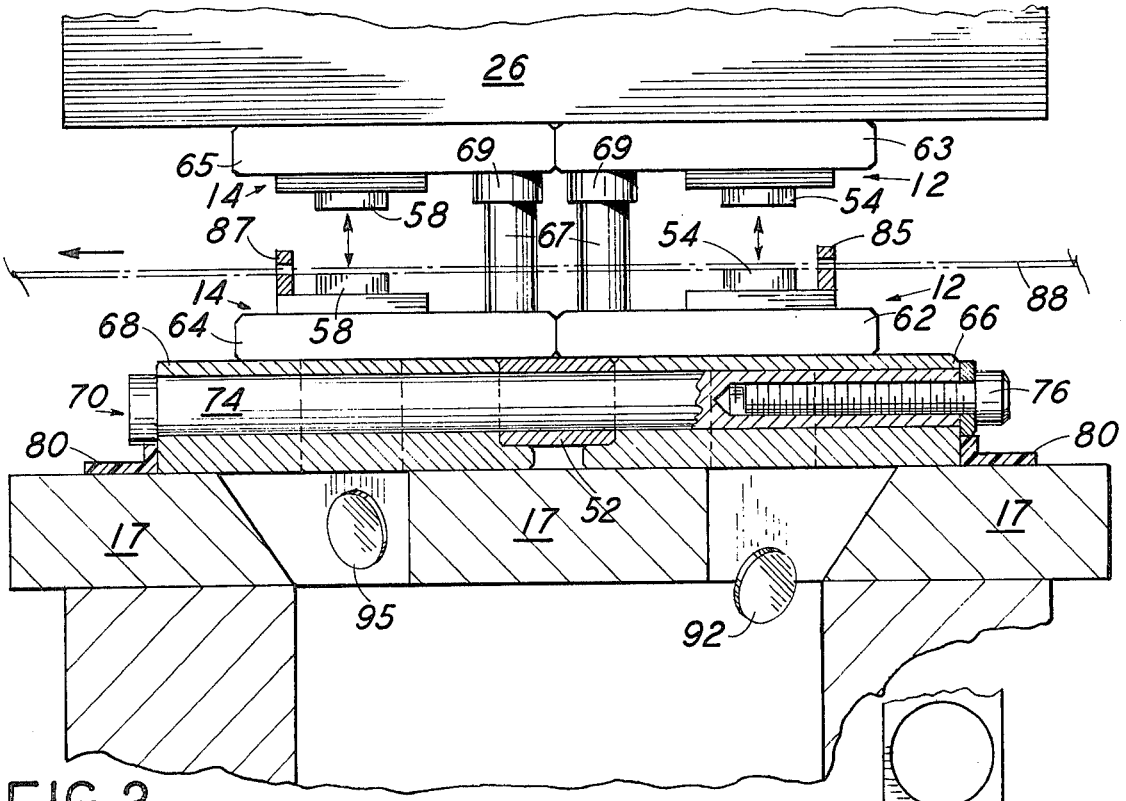
FIG. 3 is a cross-sectional partially broken away side elevational view of the multi-track machine press of FIG. 1 taken along line 3—3 of FIG. 2B and illustrating the cross-member assembly and its interaction with the drive assembly and slides of the present invention.

As best seen in FIG. 1 and 3, a multi-track machine press 10 according to the present invention utilizes two or more tracks of master die sets 12 and 14. The two master die sets 12 and 14 each have a lower half 62 and 64 as well as an upper half 63 and 65 respectively. The basic operation of the machine press is similar to that disclosed in U.S. Pat. No. 3,862,564, Blase, entitled "Machine Press With Positive Cam Driven Sliding Bed and Cam Activated Auxiliary Systems", which is incorporated by reference.

In particular, the multi-track machine press includes a base 16 incorporating a bed 17 and a bed extension 42. Two upstanding supports 18 and 20 are connected to the base. A top member 22 is connected across the two vertical supports 18 and 20. Mounted on the top member is an electric motor 35 driving crank shaft 23 via gear housing 27. The crankshaft 23 has an output beveled gear 24.

The multi-track machine press further comprises a ram 26 slidingly mounted for vertical movement on vertical guides 28 and 30. The ram is driven up and down as shown by arrow 32 once per revolution of output gear 24 by a connecting rod member 33 connected to an eccentric portion 35 of crankshaft 23.

Output bevel gear 24 cooperates with a second bevel gear 34 to rotate vertical shaft 36. The beveled gears 24 and 34 are in a two-to-one ratio and therefore shaft 36 makes one complete revoluation per two up and down cycles of ram 26.

Figures 2A, 2B, 2C:
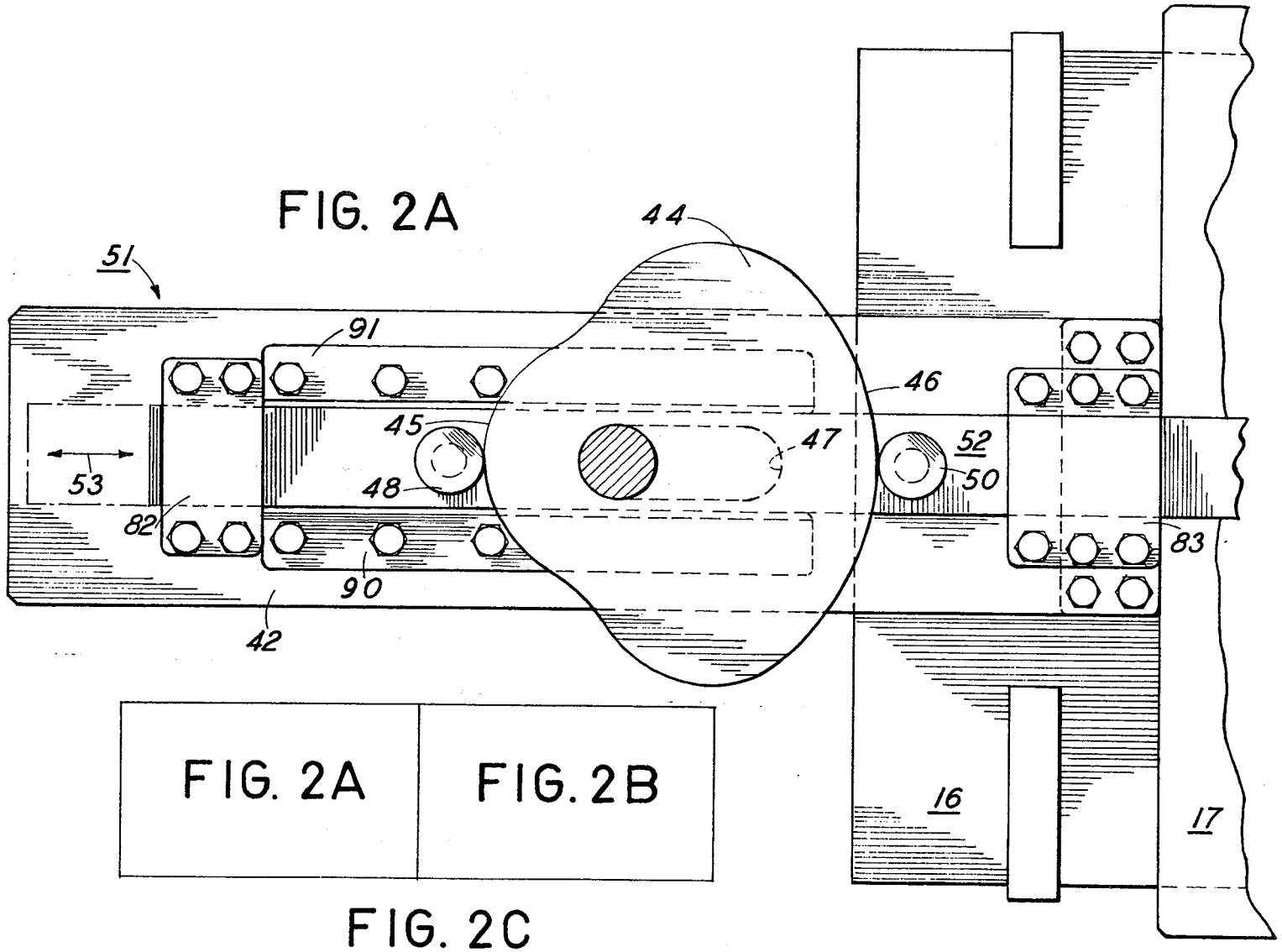
FIG. 2A is a top plan view of a portion of a multi-track machine press taken along lines 2—2 of FIG. 1 illustrating the drive assembly and a portion of the base, bed and bed extension of the base.
FIG. 2B is a top plan view of the remaining portion of the multi-track machine press taken along lines 2—2 of FIG. 1 illustrating the slides, lower portions of the master die sets, and a portion of the drive assembly of the present invention.
FIG. 2C is a diagram showing how
Figure 2B:
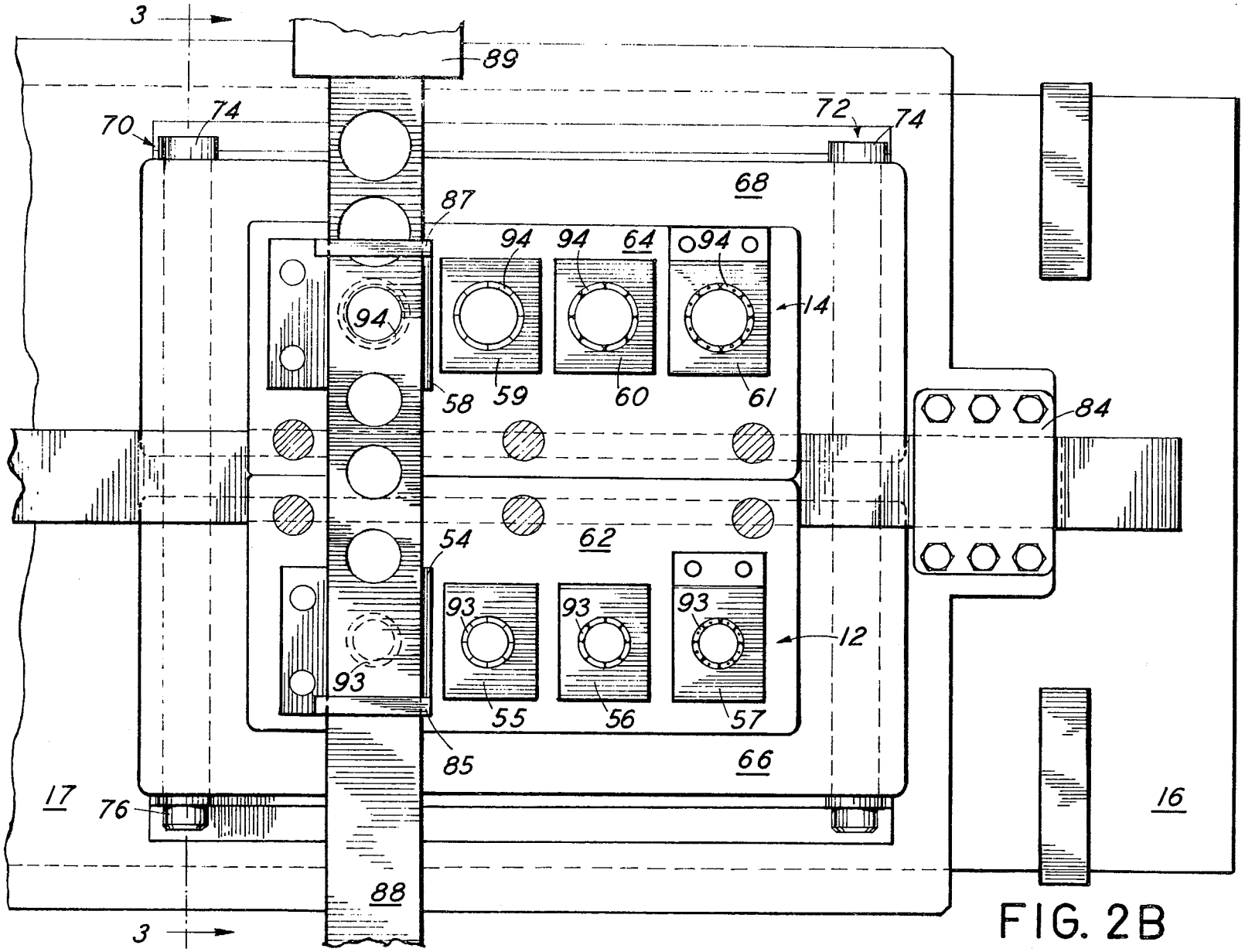

The vertical shaft 36 is supported by two bearings 38 and 40 which in turn are supported on vertical support 18. A third bearing (not shown) supports the lower end of shaft 36 connected to the bed extension 42. The shaft 36 is connected near its lower terminus to a sinusoidal cam 44. As seen in FIG. 2A, the cam is slidably positioned within slot 47 of an elongated longitudinal drive bar 52, which in turn is part of the slide assembly 51.

As best seen in FIG. 2A, the shape of cam 44 includes two regions of constant radius 45 and 46. The cam is positioned between cam followers 48 and 50 which are mounted to the elongated longitudinal drive bar 52. Thus, when the constant radius portions 45 and 46 of the cam abut against cam followers 48 and 50, no longitudinal movement of driver bar 52 occurs. It is at these times that ram 26 reaches its lowermost positions for cutting, forming or transfer operations, as more fully discussed below.

As best seen in FIGS. 1, 1A, 1B, 2A an 2B, the master die sets 12 and 14 consist of a plurality of stations to which separate dies 54, 55, 56, 57, 58, 59, 60 and 61 are placed. Each die has an upper mating half. Dies 54, 55, 56, and 57 are mounted to slide 62 while dies 58, 59, 60 and 61 are mounted to slide 64. Coil strip stock 88 is positioned over the lower portion of dies 54 and 58 by guides 85 and 87, which in turn are mounted to slides 62 and 64 respectively. The coil strip is fed through the machine press by a standard stock feeder 89. The stock feeder feeds the coil or material strip a desired feed length when the die sets are apart.

When the ram reaches its lowermost working stroke point as shown in FIG. 1A, the dies are aligned for cutting and stamping operations. At this time, drive bar 52 is at its right-hand most position as shown in FIGS. 2A and 2B and radius portions 45 and 46 of cam 44 are respectively adjacent cam followers 48 and 50. Also at this time, blanks 93 and 94 are cut from the coil strip stock while forming operations, such as those shown in FIG. 2B, are performed by dies 55, 56, 57, 59, 60 and 61 to previous cut blanks 93 and 94. As seen in FIG. 3, scrap pieces 92 and 95 drop through apertures in the slides 66 and 68 and bed 17.

Three pillar posts 67 mounted to the lower halves 62 and 64 of each of the master die sets 12 and 14 engage with three bushings 69 mounted to each upper half of the corresponding die set. The pillar post and bushing combination insure the proper alignment of the dies. There are three pillar posts and five bushings per master die set, the pillar posts engaging with three bushings during each work stroke for cutting and stamping operation and the remaining two bushings during each deposit stroke for transfer operations. During the deposit stroke one pillar post on each master die set extends beyond the upper half of the die set, therefore not engaging with any bushing.

As best seen in FIGS. 2B and 3, the lower halves 62 and 64 of the master die sets 12 and 14 are mounted to slides 66 and 68 respectively. These master die sets' lower halves 62 and 64 are positionable with respect to each other by lateral positioning of slides 66 and 68. The slides are positionable with respect to each other by means of cross-member assemblies 70 and 72.

Figure 4:
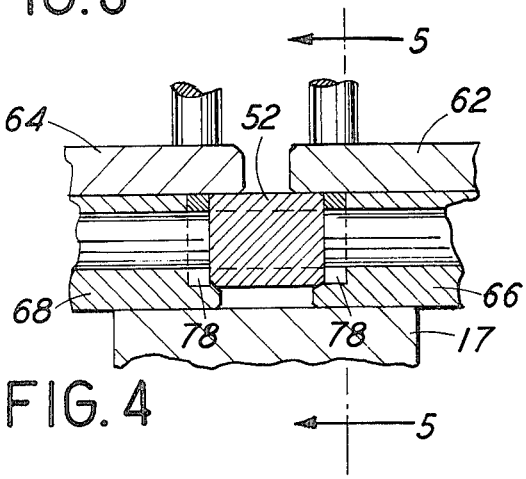
FIG. 4 is an enlarged cross-sectional partially broken away view of the lower portion of the master die sets, the slides, and drive bar of the present invention as shown in FIG. 3.
Figure 5:
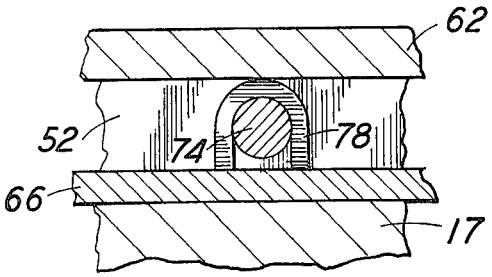
FIG. 5 is an enlarged cross-sectional partially broken away front elevational view taken along line 5—5 of FIG. 4, of the cross-member assembly, slide, drive bar and lower portion of the first master die set of the present invention illustrating the use of spacers therewith.

As shown in FIGS. 2B and 3, two adjustable slide positioning cross-member assemblies 70 and 72 each comprise an elongated shaft 74 and a threadably interfitting locking bolt 76. As shown in FIG. 3, slides 62 and 64 are in closest proximity to each other when master die sets lower halves 66 and 68 abut against drive bar 52. As shown in FIGS. 4 and 5, if it is desired that lower die set halves 62 and 64 be laterally displaced from each other, locking bolt 76 is loosened allowing slides 66 and 68 to be backed off from drive bar 52 for insertion of one or more U-shaped spacers 78 about shaft 74, followed by tightening of locking bolt 76. Spacers may be placed on either or both sides of drive bar 52.

As best seen in FIG. 1B, when the ram next reaches its lowermost position during a deposit stroke, the dies are aligned for transfer of the blanks from the upper dies to the lower dies. The drive bar 52 is now at its left-handmost position as shown in phantom in FIGS. 2A and 2B and has thus moved one die lead; i.e., distance between two adjacent stations. Pillar posts 67 again mate with alternate bushings 69 for proper alignment of the dies.

The drive bar 52 thus moves back and forth one die lead as shown by arrow 53 in FIG. 2A. The actual mechanism for transfer of the blanks from the upper dies to the aligned lower dies may be of any conventional type, such as that disclosed in U.S. Pat. No. 3,862,564.

Due to the rigid interconnection between the slides 66 and 68 with drive bar 52, longitudinal movement of drive bar 52 causes corresponding longitudinal movement of slides 66 and 68 and in turn, lower die set halves 62 and 64. Slides 66 and 68 slide across the upper surface of bed 17, as best seen in FIG. 3. Guards or shields 80, made from plastic or other suitable materials, are attached to slides 66 and 68 for guarding areas of the bed 17 against accidental damage.

As best seen in FIGS. 2A and 2B, drive bar 52 is positioned through apertured pillow blocks 82, 83 and 84 mounted to bed extension 42 as well as bed 17. As shown in FIGS. 2A and 2B, when cam 44 is positioned such that radius 46 is against cam follower 50, drive bar 52 is at its furthest right-handmost position for cutting and forming operations. More particularly, when the drive bar is in the right-handmost position upper and lower dies 54 and 58 are in alignment with each other for removal of respective blanks 53 and 54 from coil strip stock 88.

In a similar manner, when the constant radius portion 46 is next to cam follower 48 and radius portion 45 is against cam follower 50, the drive bar 52 is at its further left-handmost position, (as best seen in FIG. 1B). In this position, the lower portion of dies 55, 56, 57, 59, 60 and 61 are aligned respectively with the uppermost portion of dies 54, 55, 56, 58, 59 and 60. At this time, the blank is removed from the uppermost die and placed in the lower portion of the next die for a transfer operation as fully explained in U.S. Pat. No. 3,862,564, Blase. In this manner, a blank removed from the coil strip stock 88 is transferred and formed by the successive dies as illustrated in FIG. 2B.

As best seen in FIG. 2A, upstanding ways 90 and 91 are attached to bed extension 42 along a portion of drive bar 52. These ways contact drive bar 52 and absorb the side forces exerted against the drive bar due to rotation of cam 44.

As best seen in FIGS. 2B, 6A and 6B, cutting dies 54 and 58 may remove blanks from the coil strip stock 88 in any desired configuration. To accomplish this result, the cross-member assemblies 70 and 72 are adjusted to properly space slides 62 and 64 and thus cutting dies 54 and 58 from each other. The stock feeder is then adjusted to feed the material a desired amount so that no portion of the blank removed by the first cutting die 54 is within the cutting perimeter of the second cutting die 58. Most of these configurations can be chosen so as to greatly minimize coil strip waste. Thus, as seen in FIG. 2B, concentric blanks 93 and 94 may be removed from the coil strip stock 88. Such concentric blanks allow the first part 93 to be made from the center of part 94 which would otherwise be scrap. The two tracks of master die sets also allow the machine press to form and shape two different type blanks in two separate die operations at the same time.

FIG. 6A illustrates a situation where cutting die 54 removes an L-shaped blank 96 in the region of arrow 97 while cutting die 58 removes a square shaped blank 98 in the region of arrow 99 along the two sides of the L-shaped blank removed from coil strip stock 88. FIG. 6B illustrates a tandem blanking arrangement where cutting die 54 removes a circular blank 100 from coil strip 88 in the region of arrow 97 while cutting die 58 removes an identically shaped blank 102 from the coil strip in the region of arrow 99. In this situation, the stock feeder 89 (see FIG. 2B) feeds the coil strip twice the normal feed length so that cutting die 58 is always positioned over a portion of strip 88 which has not been previously removed by cutting die 54.

Thus, what has been described is a multi-track machine press capable of simultaneously forming finished items on a plurality of master die sets operating in unison on one machine press. Each master die set is positioned on a slide that in turn is positionable laterally with other slides by means of cross-member adjusting assemblies. A drive assembly is connected to the cross-member assembly for moving the slides back and forth. The dies on each master die set are then able to cut, form and transfer blanks into finished parts.

Although the present invention is shown utilizing two master die sets on two separate slides, more than two master die sets may be used in accordance with the present invention. Furthermore, although the driving mechanism for moving the drive assembly as shown in the preferred embodiment of the present invention incorporates a cam and cam follower positively driven by the motor driving the ram, alternative methods for driving the drive assembly would be obvious to one of ordinary skill in the machine press art.

It will thus be seen that the objects set forth above, and those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all the generic and specific features of the invention herein described, and all statements of the scope of the invention which, as a matter of language, might be said to fall therebetween.

I claim:

1. A multi-track machine press comprising:

A. a base with at least two upstanding members;

B. a ram movably mounted to the upstanding members of the base;

C. a first motor driven upper shaft rotatably mounted in the upstanding members of the base;

D. connecting means for driving the ram from said first upper shaft;

E. a second shaft driven by said first upper shaft in a two-to-one gear reduction;

F. a cam mounted near the lower end of said shaft, said cam having constant radii portions;

G. a drive bar having upstanding cam followers interacting with said cam, wherein rotation of said cam imparts linear movement to the drive bar;

H. at least two apertured pillow blocks interconnected to the base through which said drive bar passes for maintaining orientation of said drive bar;

I. at least two slides mounted for sliding movement on the base, said sliding movement perpendicular to the movement of the ram; and J. lateral positioning means interconnected with said slides for positioning said slides with respect to each other and for interconnecting said slides to the drive bar; whereby rotation of the upper shaft causes the ram to repetitively move between its uppermost and downwardmost positions while said slides repetitively move between their left-handmost and right-handmost positions.

2. A multi-track machine press comprising:

A. a base with at least two upstanding members;
B. a ram movably mounted to the upstanding members of the base;
C. first means for repetitively moving said ram perpendicular to the base;
D. N slides mounted for sliding movement on the base, said sliding movement perpendicular to the movement of the ram, where N is an integer greater than one;
E. second means, connected to the base and the slides, for slidably moving said N slides back and forth with respect to the base;
F. third means, interconnected with the slide moving means and the slides, for laterally positioning said slides with respect to each other, incorporating at least two members releasably laterally secured to the slides and having a plurality of spacers removably placed on said members for insuring maintenance of the proper spacing of each slide with respect to each adjacent slide.

3. A multi-track machine press as defined in claim 2, further comprising:
G. guard members attached to at least a portion of the perimeter of the slides and extending away from the slides for protecting the portion of the base in proximity with the slides from user tools or external damage.

4. A multi-track machine press as defined in claim 2, wherein the repetitive ram moving means incorporates:
a. a first motor-driven upper shaft rotatably mounted to the upstanding members of the base; and
b. connecting means for driving the ram from the first upper shaft,
and wherein the slide moving means incorporates:
a. a second shaft driven by the first motor-driven upper shaft;
b. a cam mounted on said second shaft;
c. a drive bar interconnected with the lateral positioning slide means; and
d. cam followers upstanding from the drive bar interacting with the cam, wherein rotation of the second shaft and cam mounted thereon causes longitudinal movement of the drive bar and consequent back and forth sliding movement of the slides.

5. A multi-track machine press as defined in claim 2, wherein the slide moving means incorporates:
a. an elongated slidable longitudinal bar interconnected with the slide lateral positioning means and the base,
b. at least two square apertured pillow blocks connected to the elongated longitudinal bar for maintaining the desired longitudinal path of said longitudinal bar, and
c. means for reciprocally moving said longitudinal bar along said desired longitudinal path.

6. A multi-track machine press as defined in claim 5, wherein said reciprocating means incorporates a rotatable cam and at least two cam followers secured to said longitudinal bar.

7. A multi-track machine press as defined in claim 5, further comprising at least two ways mounted to the base adjacent the portion of the longitudinal bar in proximity to said cam for counteracting side thrust forces exerted on the longitudinal bar by rotation of the cam.

8. An improved machine press of the type having:
a. a base and supports upstanding therefrom;
b. a motor-driven upper shaft rotatably mounted in the supports upstanding from the base;
c. a ram mounted for sliding movement perpendicular to the base;
d. connecting means for driving the ram from the upper shaft;
wherein the improvement comprises:
A. at least two slides, mounted for sliding movement with respect to the base, said sliding movement being perpendicular to the movement of the ram;
B. first means for positioning said slides with respect to each other; and
C. second means, interconnected with the upper shaft, for causing sliding movement of the slides,
wherein the slide positioning means incorporates at least two members releasably laterally secured to the slides, and wherein the slide positioning means incorporates a plurality of spacers mountable to said two members for maintaining lateral positioning of said slides with respect to each other.

9. An improved machine press, for performing successive stamping operations to blanks from a coil strip stock, of the type having:
a. a base;
b. a ram movably mounted to the base for sliding movement perpendicular to the base;
c. means, interconnected between the base and the ram for reciprocally moving the ram perpendicular to the base;
wherein the improvement comprises:
A. N slides mounted for sliding movement with respect to the base, said sliding movement being perpendicular to the movement of the ram, where N is an integer greater than one;
B. means for positioning said slides with respect to each other;
C. second means interconnected to the base of said ram moving means for causing sliding movement of the slides; and
D. third means for feeding the coil strip stock across a portion of each slide,
wherein the slide positioning means incorporates at least two members releasably laterally secured to the slides, and a plurality of spacers removably positioned on said members for insuring maintenance of the proper spacing of each slide with respect to each adjacent slide.

* * * * *